US005312645A

United States Patent [19]

Dressler

[11] Patent Number: 5,312,645

[45] Date of Patent: May 17, 1994

[54] HEAT-APPLIED ATHLETIC LETTERING

[76] Inventor: Donald R. Dressler, 22 Colony Cir., Glastonbury, Conn. 06033

[21] Appl. No.: 805,000

[22] Filed: Dec. 10, 1991

[51] Int. Cl.[5] ..... B41M 3/12

[52] U.S. Cl. ..... 427/148; 427/152; 427/412.5

[58] Field of Search ..... 427/147, 148, 152, 412.5

[56] References Cited

U.S. PATENT DOCUMENTS

| | | | |
|---|---|---|---|
| 3,660,212 | 5/1972 | Liebe | 428/41 |
| 3,987,225 | 10/1976 | Reed et al. | 428/43 |
| 4,103,053 | 7/1978 | Barehas | 428/40 |
| 4,269,885 | 5/1981 | Mahn | 428/216 |
| 4,356,617 | 11/1982 | Coscia | 427/147 |
| 4,423,106 | 12/1983 | Mahn | 428/207 |
| 4,687,680 | 8/1987 | Narui et al. | 427/148 |
| 4,704,310 | 11/1987 | Tighe et al. | 427/148 |
| 4,780,340 | 10/1988 | Takahashi et al. | 427/412.5 |
| 4,786,349 | 11/1988 | Mahne Sr. . | |
| 4,810,549 | 3/1989 | Abrams et al. . | |
| 4,855,171 | 8/1989 | McKie et al. | 428/40 |
| 4,910,070 | 3/1990 | Al'Hariri | 427/152 |
| 4,938,617 | 7/1990 | Mecke et al. | 427/148 |
| 5,008,139 | 4/1991 | Ochi et al. | 428/40 |
| 5,026,584 | 6/1991 | Logan | 428/41 |
| 5,112,423 | 5/1992 | Liebe, Jr. | 156/234 |

OTHER PUBLICATIONS

Stahls' Encyclopedia of Heat Applied Lettering, 2nd Edition, Version 2.1, pp. 1,5,6,8,10,13,23-25,28,29,39,42,44,53,57,77, 1984 (No month available).

*Primary Examiner*—Beck Shrive
*Assistant Examiner*—Diana Dudash
*Attorney, Agent, or Firm*—Chilton, Alix & Van Kirk

[57] ABSTRACT

A web is fabricated by coating at least one layer of thermoplastic material, pigmented polyurethane, onto a transparent polyester plastic film. The resulting web can readily be cut by a computer controlled blade to produce virtually any graphic pattern, including intricate or small letters that may be connected or separated from each other, without penetration of the blade through the carrier sheet. The graphic sheet adheres strongly enough to the carrier sheet, with a peel value in the range of 15-30 ounces, to prevent sliding of the graphic sheet relative to the carrier sheet during cutting, yet permitting release of the carrier sheet after attachment of the graphic by the application of heat and pressure. Thus, the present invention provides an "adhesive up" type of web for polyurethane graphics, whereby the graphic can be cut and peeled from the web, and the graphic, while still adhered to the carrier sheet, placed against the fabric. The transparent plastic carrier sheet permits exact placement of the graphics on the fabric, e.g., on or relative to a shirt pocket.

16 Claims, 2 Drawing Sheets

HEAT-APPLIED ATHLETIC LETTERING

BACKGROUND OF THE INVENTION

The present invention relates to a layered plastic web, particularly adapted for attachment through heat and pressure to fabric.

For many years, the attachment of cloth numerals and/or other identifying information on athletic attire, was made by stitching. For less demanding conditions, including casual sportswear, logos and the like were either attached to the garment by stitching or applied by silk screening.

More recently, the development of thermoplastic films, such as vinyl and polyurethane, has progressed to the point where lettering can be attached directly to the fabric, by the application of heat and pressure. Once attached, the thermoplastic letters retain sufficient flexibility to resist embrittlement and cracking, without separating from the fabric during washing and drying.

The conventional procedure typically includes stacking a plurality of sheets of lettering web material. A die or other cutting means such as a water knife, cuts through the plurality of sheets simultaneously, forming distinct letters or numbers. Thus, a stack of sheets, when cut, may produce dozens of identical characters, for example, the letter "A". In a similar fashion, other stacks of sheets are cut with the characters "B", "C". . . "1". . . "9", etc. Packages of the characters are provided to the athletic lettering retailers, who can arrange particular letters, for example, the name of a player, on a jersey and, by the application of heat and pressure on each letter individually, or on all the letters as arranged on the jersey, attach them to the fabric.

U.S. Pat. No. 3,660,212, issued to Liebe, Jr. on May 2, 1972, discloses one type of material for athletic lettering. The material of the Liebe patent has two layers of polyvinylchloride bonded to each other. Furthermore, one of the layers of polyvinyl- chloride is releasably adhered to a release coated paper sheet. During application on fabric, the cut lettering material of the Liebe patent requires the release sheet backing, to which heat is applied for causing the material to adhere to the fabric of the uniform. This adhering of the lettering material of the Liebe patent to the material of the sport uniform is a mechanical bonding. This is due to the lettering material sinking into the material of the sport uniform and encapsulating the fabric. This type of web can be referred to as an "adhesive up" web, because the top surface of the web prior to cutting, ultimately adheres to the fabric.

A variation of the vinyl lettering described in the Liebe patent, is marketed by Stahls, Inc. of St. Clair Shores, Michigan, and consists of a release coated paper carrier sheet, on which a pigmented, stretch vinyl layer has been applied by casting (i.e., solution coating). A top layer of adhesive is carried on the vinyl, i.e., as an "adhesive up" lettering system.

Vinyl lettering exhibits a number of disadvantages, as mentioned, for example, in Stahls, Encyclopedia of Heat Applied Lettering, Second Edition, Version 2.1 (Library of Congress Registration TXU133-924). The vinyl material itself, has relatively low tensile strength and tear resistance, requiring the use of a relatively thick vinyl letter. Vinyl has relatively low flexibility, which becomes even worse as temperature decreases. The extra weight and inflexibility of large vinyl lettering on athletic jerseys, represents a significant disadvantage. Moreover, vinyl does not resist abrasion, which is another disadvantage in athletic attire as well as casual attire worn for vigorous activities. For example, on the well known Taber test for abrasion resistance, vinyl material is abraded at the rate of 178 mg. This compares poorly with other material such as nylon (44 mg), or urethane (3 mg).

Another disadvantage of the vinyl coated release paper for lettering purposes, arises from the fact that the carrier sheet is release-coated on only one side, with the result that the penetration of moisture from the other side induces curling of the paper. This curling can stress the vinyl such that it, too, has a tendency to curl onto itself.

When such vinyl letters are die cut and stored for a period of time, curling can become a significant problem when the end user attempts to carefully place the cut numerals precisely on the desired location on the fabric. Moreover, the release coating on the paper may not be uniform, with the result that any overlap of the paper over the edges of the vinyl letter, tends to stick to the fabric during the application of heat and pressure through the carrier sheet.

These disadvantages of vinyl lettering, particularly the tendency to curl with the resulting separation of the vinyl material from the carrier sheet, renders vinyl ill-suited for small letters. Known vinyl-based webs for athletic lettering, are not amenable to precision cutting of complex logos or small lettering, as by the use of a computer controlled cutting blade. The susceptibility of the vinyl web to curling, coupled with the rather low peel value of less than 5 ounces between the vinyl and the release-coated sheet, would result in lateral movement of the vinyl on the release sheet adjacent the cutting edge of the blade (which travels horizontally through the web). The edges of the letters would therefore not be cut cleanly, and the resulting shear forces coupled with the inherent tendency of the paper and/or vinyl to curl, would result in the cut letters lifting from the carrier sheet during the cutting operation.

A related disadvantage in the use of vinyl letters, is that in order to achieve satisfactory opacity, the vinyl material must be relatively thick. Nevertheless, commercially available vinyl webs for athletic lettering, typically come with a warning not to apply them to fabrics which have a pattern, for example, a pin-striped baseball jersey. The chance of "strike through" is especially critical with fabric of this type. Moreover, users are typically warned to store the inventory away from heat, and the lettered garments are not to be dry cleaned.

As described in Stahls' Encyclopedia, keeping letters aligned before application has always been a problem. When vinyl letters have been applied and a mistake is discovered, the garment must either be repaired or discarded. Repair of misapplied vinyl letters, typically require considerably physical effort, the use of foul-smelling toxic solvents, and the dirtying of one's hands. Solvents typically used for repair purposes, are either extremely flammable, caustic, or poisonous. The use of vinyl lettering is prone to mistakes, in part due to alignment problems inherent in the placement of individually die cut letters on the garment, e.g., curling or static electricity makes the letters "jump" when a cover sheet, heat resistant tape, or platen come near by.

Because of the disadvantages associated with vinyl, polyurethane has recently been recognized as a superior but more expensive material for athletic lettering. Although the performance of urethane lettering is superior to that of vinyl, urethane materials are more difficult to apply. This is due in part to the difficulty in preparing a satisfactory urethane laminate web which includes layers that exhibit significantly different coefficients of thermal expansion, or elasticity. The advantages of urethane relative to vinyl, however, are overwhelming. Urethane has at least twice the tensile strength, tear resistance, and elongation capability, relative to vinyl. The flexibility of urethane is maintained at low temperatures. The abrasion resistance, as noted above, is far superior.

U.S. Pat. Nos. 4,269,885 and 4,423,106, issued May 26, 1981 and Dec. 27, 1983 to Mahn, disclose a laminated web consisting essentially of two films, preferably a polyester adhesive bonded to a die-extruded polyurethane lettering layer. After characters are cut out of the web, the polyester adhesive layer is placed against the fabric, a paper cover is placed over the polyurethane layer, and heat and pressure are applied. The melting point of the polyester adhesive is lower than that of the polyurethane, so that the polyester melts into the fabric.

It may be possible that, if the release coated paper carrier sheet used during fabrication of the laminate is retained, a somewhat more complex graphic pattern, for example, a team emblem or logo, can be cut, using programmable cutting equipment. This would, however, be considered an "adhesive down" web, because the polyester adhesive surface which ultimately adheres to the fabric, is hidden between the release coasted carrier sheet and the polyurethane letter material.

Significant problems, however, are presented to anyone who cuts elastomeric letters from the Mahn web, by computer. For example, the presence of a release coating on the carrier sheet prevents the precise cutting of the polyurethane layer. This is in large part a result of the flexibility of the polyurethane, and the softness of the polyester adhesive between the polyurethane and carrier sheet. Unless great care is taken, sharp corners and edges cannot be preserved on the cut web. The adhesive between the polyurethane and carrier sheet, thus presents a practical size limitation on the lettering, i.e., small, precise letters and designs cannot be cut due to the excessive flexibility of the polyurethane and underlying adhesive as the knife makes corner cuts. This relationship between the adhesive and the cutting impression, especially at the corners, makes weeding away the unwanted portion of the web very difficult.

Thus, despite recent advances in the state of the art, the current technology represented by the transfer of elastomeric, thermoplastic lettering by the application of heat and pressure suffers from significant disadvantages.

SUMMARY OF THE INVENTION

These disadvantages are overcome by the present invention, which is embodied in a novel web, method of making a web, and method for applying lettering or other graphics to a fabric. The invention results in a garment having a logo thereon of superior quality to that available in the prior art.

A general object of the present invention is to provide an "adhesive up" type web by which an elastomeric, thermoplastic graphic sheet releasbly adhered to a carrier sheet, can be readily cut by intricate movement of a computer-controlled blade and peeled to form a reverse graphic pattern on the carrier sheet, which may then be attached to a fabric or other substrate by the application of heat and pressure through the uncut carrier sheet.

It is another object of the present invention to provide an "adhesive up" type web for athletic lettering or the like, in which no adhesive layer is required between the carrier sheet and the graphics sheet.

It is yet another object of the invention to provide a wide variety of surface textures on the visible surface of the graphic in the finished garment.

According to the present invention, a web is fabricated by coating at least one layer of thermoplastic material, preferably pigmented polyurethane, onto a transparent or translucent plastic film, preferably polyester. The resulting web can readily be cut by a computer controlled blade to produce virtually any graphic pattern, including intricate or small letters that may be connected or separated from each other, without penetration of the blade through the carrier sheet. The graphic sheet adheres strongly enough to the carrier sheet, preferably with a peel value in the range of 15–30 ounces, to prevent sliding of the graphic sheet relative to the carrier sheet during cutting, yet permitting release of the carrier sheet after attachment of the graphic by the application of heat and pressure.

Thus, the present invention provides an "adhesive up" type of web for polyurethane lettering, whereby the graphic can be cut and peeled from the web, and the graphic, while still adhered to the carrier sheet, placed against the fabric. The clarity of the plastic carrier sheet permits exact placement of the letters on the fabric, e.g., on or relative to a shirt pocket. Furthermore, the ability to cut the entire graphic on the web, without the need to pick the graphic up from the carrier sheet as individual letters or the like for placement on the fabric, offers the significant advantage of reduction in time to complete the lettering on the garment, and it further virtually eliminates mistakes in alignment of the letters on the garment. As long as the alignment and relationship of the letters is correct (in reverse) on the graphic cut on the web, the same relationship will also be present on the garment.

The combination of the clear plastic carrier sheet and at least one layer of cast polyurethane adhering directly to the carrier sheet provides, for the first time, optimization of the important lettering characteristics of thickness, flexibility, and opacity. Polyurethane is inherently flexible, but high opacity was achieved conventionally by providing a relatively thick layer of the material. Polyurethane is expensive and the increased thickness increases the weight while decreasing the estethic appearance of the letters. With the present invention, a relatively thin layer of a first pigmented polyurethane is coated onto the carrier sheet, followed by a second, white polyurethane coating, resulting in a graphic sheet that is flexible, exhibits high opacity, yet is thin and light weight. Preferably, a third polyurethane adhesive coating is also coated to define the "adhesive up" surface of the web, which, on the cut letters, will ultimately attach the letters to the fabric. Since the smooth, plastic carrier sheet is in intimate, adhesive contact with the coated layer that will ultimately be visible on the garment, the appearance, i.e., texture and gloss quality of the logo can be controlled by selecting for the carrier sheet, a plastic having an appropriately textured surface.

Whereas conventionally, polyurethane used in lettering is first formed as a film in a flat die or blown film type of extrusion process, the polyurethane of the present invention is applied directly onto the plastic carrier sheet by casting, i.e., solution coating. In this process, a polyurethane resin is dissolved along with pigment material in a solvent at a ratio of up to about 30% solids and 70% solvent. This produces uniformity of color and, when applied in a conventional casting technique, produces a uniformity of thickness on the carrier sheet.

The direct coating has the advantage of producing significant adhesion upon drying. This is in contrast to known lettering techniques, whether of the "adhesive up" or "adhesive down" type, wherein to the extent a carrier sheet is present it is a release-coated paper to provide low adhesion, on the order of only a few ounces of peel value. The peel value between the polyurethane coating of the present invention and the carrier sheet, is significantly higher, due to the adhesive forces arising upon the drying of the wet coating onto the smooth plastic surface of the carrier sheet. The coated polyurethane also does not exhibit die marks that often accompany extruded polyurethane films. Similarly, the application of the polyurethane as a liquid coating does not give rise to internal stresses or preferred orientations in the layer, which, in webs containing extruded films, contribute to curling or other dimensional instabilities.

Furthermore, the use of the coating process in accordance with the present invention permits the sequential application of somewhat dissimilar materials having, for example, different melt points, expansion coefficients, or the like. Such composites are extremely difficult, if not impossible, to achieve by co-extrusion of thin layers, e.g., on the order of one or two mils as preferred for the present invention.

BRIEF DESCRIPTION OF THE DRAWINGS

These and other objects and advantages of the invention are described below with reference to the accompanying drawings, where like numerals represent like structure, and wherein.

DESCRIPTION OF THE PREFERRED EMBODIMENT

Figure 1:
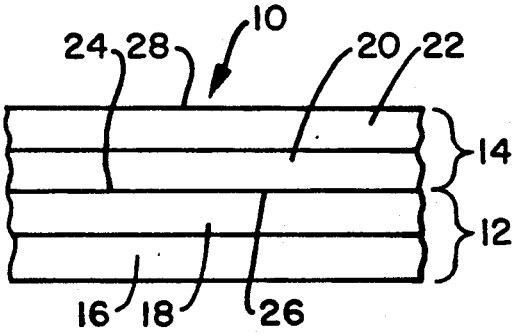
FIG. 1 is a schematic representation of a first embodiment of a web in accordance with the present invention, having a carrier sheet and an adhered graphic sheet.

FIG. 1 shows a web 10 for athletic lettering in accordance with a generalized first embodiment of the invention. The web 10 has two basic components, a carrier sheet 12 adhered to a graphics sheet 14. The carrier sheet 12 includes a base layer 16, which is optionally surface treated at 18 to control adhesion or texture. The graphics sheet 14 has a pigment layer 20, on which is carried a fabric adhesive layer 22. The base layer 16 is preferably clear polyester film, and pigment layer 20 is preferably a coated thermoplastic material, especially elastomeric, such as polyurethane. As will be described below, carrier sheet 12 can be separated from the graphics sheet 14 when the web 10 has been attached to the fabric by means of the melting of fabric adhesive 22. In other words, the upper surface 24 of the carrier sheet 12, i.e., the first adhesive surface 24, is separable from the graphics sheet 14, at the lower surface 26 of the pigment layer 20, when the second adhesive surface 28 is secured to the fabric.

Figure 2:
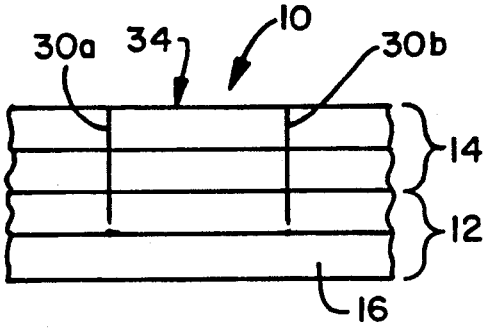
FIG. 2 shows the web of FIG. 1, including cut lines produced by a cutting blade to define a graphic.

This type of web 10 is adapted for the cutting, as at cut lines 30A,30B of FIG. 2, to produce an athletic letter, numeral, logo, or the like, hereinafter to be referred to generally as a graphic. It may be appreciated from FIG. 2, that the cut lines 30A,30B penetrate entirely through the graphics sheet 14 into the carrier sheet 12, but do not penetrate the base layer 16 of the carrier sheet 12.

Figure 3:
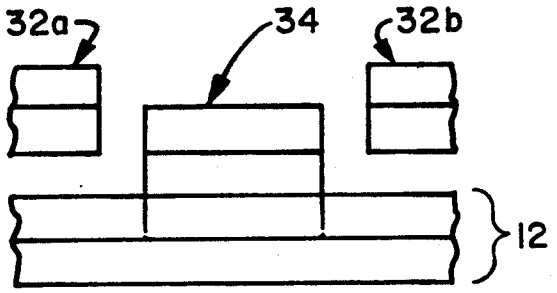
FIG. 3 shows portions of the graphic sheet peeled away from the web to reveal the cut graphic as retained on the carrier sheet.

As shown in FIG. 3, the excess portions 32A,32B of the graphics sheet are removed after the entire graphic has been cut, thereby leaving the graphic 34 adhered to the carrier sheet 12.

Figure 4:
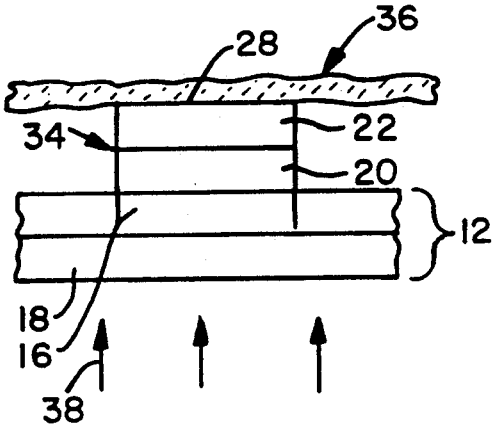
FIG. 4 shows the cut graphic and carrier sheet as placed against a portion of a garment with the application of heat and pressure through the carrier sheet to bond the graphic to the fabric.

As shown in FIG. 4, the peeled web is then placed against the fabric, such that the surface 28 of the fabric adhesive layer 22 is in contact with fabric 36. This is followed by the application of heat and pressure, shown generally at 38, through the carrier sheet 12, whereby the fabric adhesive 22 melts into the fabric 36, thereby attaching the graphic 34 thereto.

Figure 5:
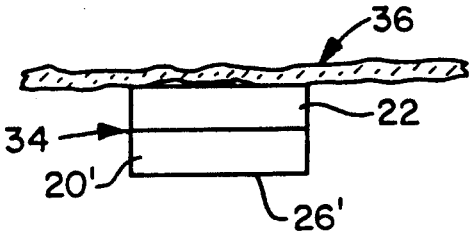
FIG. 5 shows the graphic adhered to the garment at the conclusion of the lettering process, after the carrier sheet has been removed.

The final step is the separation of the carrier sheet 12 from the graphic 34, leaving the configuration shown in FIG. 5. The texture of visible surface 26' of the pigment layer 20', is dictated substantially entirely by the nature of the intimate contact between surfaces 24 and 26 (as shown in FIG. 1), during the fabrication of the web and the subsequent heating and removal steps described immediately above. It should be further appreciated that, as used herein, the term "pigmented" is used in a general sense to mean material that imparts color; this includes printed, dyed, beaded, and equivalently treated plastic layers. Clarity or transparency of the carrier sheet 12 facilitates the exact placement of the graphic 34 on the fabric 36, because the fabric is visible through the carrier sheet 12. The use of a polyester film for the base layer 16 has the further advantage that the polyester, being somewhat stiff and resistant to temperature-induced deformation, "holds up" the graphic 34 during the application of heat and pressure through the carrier sheet 12. This reduces the extent to which the pigment layer 20 penetrates the fabric 36, and thus improves the color and texture of the completed graphic. Ideally, when a fabric adhesive 22 is used in the web, only the adhesive 22 should penetrate the fabric. Where no fabric adhesive 22 is used, satisfactory appearance of the finished graphic 34 can still be obtained when the degree of pigment layer 20 penetration of the fabric is kept to the minimum necessary to achieve attachment for the useful life of the garment.

Figure 6:
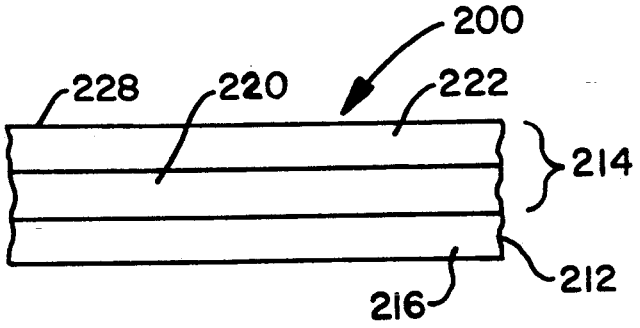
FIG. 6 is a schematic of a second embodiment of the invention, in which the carrier sheet is a plastic film and the graphic sheet consists of a pigmented thermoplastic layer adhered to the carrier sheet and a fabric adhesive carried by the pigmented layer.
Figure 7:
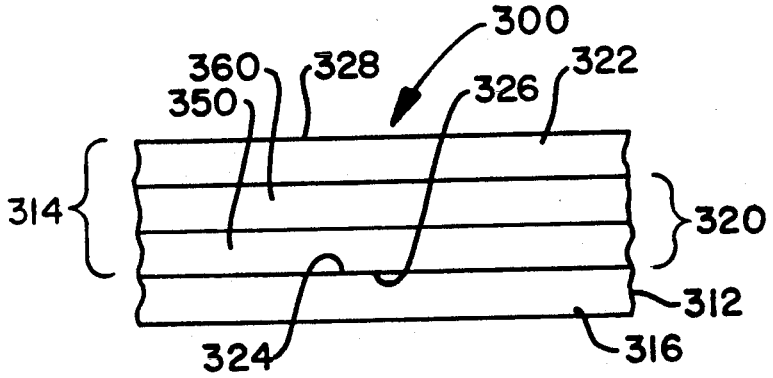
FIG. 7 is a schematic of a third embodiment of the invention, wherein the pigmented layer comprises two, sequentially coated layers of thermoplastic material.
Figure 8:
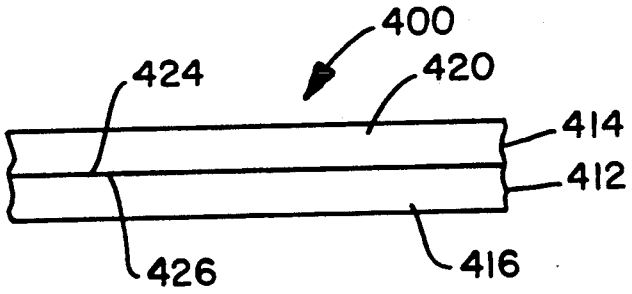
FIG. 8 is a schematic of a fourth embodiment of the invention, wherein the graphic sheet is a single coated layer of thermoplastic material adhered directly to a plastic film carrier sheet.

The first embodiment of the invention as shown in FIGS. 1-5, represents significant improvements relative to known laminated web constructions for athletic lettering. The other embodiments, shown in FIGS. 6-8, represent a radical departure from known webs. In embodiment 200 of FIG. 6, the graphic sheet 214 is coated directly on the untreated upper surface of base layer 216. Thus, the carrier sheet 212 consists of a base layer 216 that is a cut resistant plastic film, preferably clear polyester, and the pigment layer 220 is a pigmented thermoplastic material which adheres to the base layer 216 by mechanical attraction resulting from the coating process. A fabric adhesive 222 is preferably coated on layer 220. It should be understood that the pigment layer 220 is plastic at least after the graphic has been attached to the garment. Preferred materials for the pigment layer 220 include thermoplastic elastomers, such as polyurethane, but other suitable materials include resins and associated binders or adhesives that can be coated onto the base layer 216.

In another preferred form of the invention 300, shown in FIG. 7, the pigment layer 320 is a composite. The base layer 316 is a clear polyester film having a thickness of between about 4-7 mils. A 1.5 mil thick first coating 350 of a first pigmented thermoplastic resin is adhered to the base layer 316, and a second thermoplastic resin coating 360 of about 1.0 mil thickness is adhered to the first coating 350. The second resin 360 is preferably an opaque white or other light color which, in the graphic, backs up the visible first resin 350 to provide a deep, rich, appearance. A 2.5 mil thick fabric adhesive 322 on the second pigmented resin 360, completes the graphics sheet 314.

In an exemplary implementation of the embodiment of FIG. 7, the carrier sheet 312 consists of a 7 mil thick film 316 of Dupont clear Mylar. The graphics sheet 314 consists essentially of three urethane layers cast (solution coated) sequentially on the carrier sheet 16. The composite pigment layer 320 defining the visible color of the graphic consists essentially of a first, 1.5 mil coating 350 of estane thermoplastic polyurethane resin such as B.F. Goodrich 5701F-1 resin, and a second, 1.0 mil coating 360 of the same resin, but having an opaque white color. This is followed by a 2.5 mil thick layer 322 of a lower melt point fabric adhesive such as a thermoplastic urethane available as resin PS455 from Morton International. Generally, the graphic layer 314 will be less than about 6.0 mil in thickness, and the overall web 300 will be less than 15 mil, preferably less than about 13 mil in thickness.

More particularly, clear (not pigmented) urethane pellets are added to solvent such as THF, DMF or MEK. Then a pigment dispersion (e.g., organic, or inorganic such as $T_iO_2$ for white) is thoroughly mixed in to produce a resinous solution that is uniform in color and consistency. To achieve the functionality described herein, other ingredients such as cross linkers, slip agents, adhesion promoters, and blocked cross linkers may be added. In general, the solution will consist of between 15-30% solids, and more typically 25% solids. In the typical situation, up to about 20% of the solids consist of pigment. The fabric adhesive coating 322, the last to be applied, typically does not include pigment and is selected primarily for its properties as a heat activated adhesive with, generally, a lower melt point than that of the other layers.

It should be appreciated that by solution coating directly onto the smooth upper surface 324 of the plastic carrier sheet 316, a relatively high degree of natural, mechanical adhesion arises as the coating 350 dries. The plastics are formulated to produce a relative peel strength value between the carrier sheet 316 and the graphic sheet 314, in the range of about 15-30 ounces as measured by the ASTM standard method No. D-903-49 (1978). On the other hand, the bond between successive coating layers 350,360,322 are much stronger, due to the intermolecular activity resulting from the process steps by which the successive coatings are applied in solution. Thus, the graphic sheet 314 acts as a unitary member during the steps shown in FIGS. 2-5.

It should be understood, however, that even in the simple embodiment 400 shown in FIG. 8, consisting essentially of a single plastic film carrier sheet 412 and a graphic sheet 414 defined only by a single coated layer 420 of thermoplastic material such as pigmented polyurethane, the present invention exhibits significant superiority over known lettering webs and techniques. The intimate contact between the coated pigment layer lower surface 426 and the plastic upper surface 424 of the carrier sheet 412, can easily produce a very glossy surface on the final graphic. Moreover, by providing a variety of textures on the carrier sheet upper surface 426, a respective variety of surface textures can be produced on the graphic surface 424 when the carrier sheet 412 is pulled away. Furthermore, the absence of an adhesive layer between the carrier sheet 412 and the pigment layer 420 assures that the blade of a graphic cutting machine will make clean, crisp cut lines through the graphic sheet. The mechanical adhesion between the graphic sheet and the carrier sheet, and between successive layers within the graphics sheet, are strong enough to withstand the cutting action. Of course, the webs described herein may be cut by means other than a computer controlled blade.

Furthermore, as described above, the use of a polyester carrier sheet provides resistance against the pigment layer graphic penetrating too deeply into the fabric during the application of heat and pressure, even when the graphic sheet does not include a fabric adhesive layer (per FIG. 8). Another significant advantage is the greater flexibility in the choice of materials for the graphic sheet, where one need not be concerned with the melting point of a carrier adhesive. For example, materials that become thermoplastic upon heating can be used for the graphic sheet, without concern that high temperature will transfer carrier adhesive to the fabric. Whereas, the thermoplastic nature of the pigment layers enhances bonding to each other during the application of heat and pressure, the thermal stability of the polyester preserves its function as a release sheet after the application of heat and pressure.

The first coating of the pigment layer is preferably a thermoplastic elastomer, but it may be of the type which is generally known as a cross-linked material which is thermoplastic until the cross linking effect occurs. An example of this cross linker is Mondure CP75, available from Mobay. In the embodiment where a fabric adhesive layer is utilized, such adhesive can be a blocked cross-linked adhesive which cures upon heating in the manner described above. Such an adhesive melts into the fabric, without melting of the pigment layer to give added performance to the fabric adhesive.

In the preferred embodiment where two pigment coatings are provided between the carrier sheet and a fabric adhesive layer, the layers inherently bond to each other due to the coating thereof in a wet solution of resins and solvents, and the resulting interaction of the molecules as the solvents evaporate. The pigment coating adhering to the carrier sheet, may, as mentioned above, contain glitter, perlescent pigments or the like, whereas the backing coating is typically white or contains a binder tint, or the like. Preferably, the second pigment coating is white and, although normally not intended to melt, this can be used to trade off a high degree of melt with the fabric adhesive (for durability) against a low degree of melt to enhance opacity.

On the other hand, the interaction between the first coating of the graphics sheet, and the carrier sheet, must, of course, permit release after the application of heat and pressure. Various techniques are available to those skilled in the art, to control the adhesion to a peel value of preferably between 15 to 30 ounces, as measured in accordance with the ASTM standard set forth above. For example, the polyester carrier sheet can be slip-treated (not release-coated). Alternatively, the polyurethane formulation can include organo functional silane coupling agents or surfactants. It is desirable that the coatings, such as polyurethane, have a high strength concentration of molecular entanglement, so that the urethane does not slide relative to the polyester carrier sheet, as the blade cuts the graphic. In other words, the pigment layer must exhibit a high resistance to shear loads. This desirable property can be retained despite the presence of decoration in one or more components of the pigment layer.

I claim:

1. A method of fabricating a plastic web having a carrier sheet, a pigment layer, and an adhesive layer in succession for use in cutting and applying plastic lettering to fabric, comprising:

selecting a non-release coated, transparent polyester carrier film having a thickness of at least about 4 mils for said carrier sheet;

coating a first layer of pigmented polyurethane material having a first material formulation with a first dry melting point directly on the carrier sheet;

coating a second layer of unpigmented thermoplastic adhesive material having a second material formulation with a second dry melting point lower than said first melting point, directly on the first layer; and drying said first and second layers as coated on said carrier sheet to produce said web having a first layer thickness between about 1.0 to 2.0 mils and having a peel value between the first layer and the carrier sheet in the range of about 15-30 ounces.

2. The method of claim 1, wherein the carrier sheet has a slip-treated upper surface.

3. The method of claim 1, including the step of formulating the first layer of pigmented polyurethane, with at least one ingredient of the group consisting of cross-linkers, slip agents, adhesion promotors, coupling agents, or surfactants.

4. The method of claim 1, wherein the formulation of the first layer includes a material selected from the group consisting of glitter, perlescent, and beads.

5. The method of claim 1, wherein the first layer is solution coated directly on the carrier film.

6. The method of claim 1, wherein the second layer is solution coated on the first layer, while the first layer is wet.

7. A method of fabricating a plastic web having a carrier sheet and a multi-layer graphics sheet including a pigment layer and an adhesive layer releasably adhered to the carrier sheet, comprising:

selecting a non-release coated, transparent polyester carrier film having a thickness of at least about 4 mils for said carrier sheet;

forming a composite pigment layer on the carrier sheet including the steps of coating a first layer of a first polyurethane formulation having a first dry melting point directly on the carrier sheet and coating a second layer of a second polyurethane formulation having a second dry melting point directly on the first layer, wherein the composite pigment layer includes pigment material; and forming an adhesive layer on the composite pigment layer including the step of coating a third layer, of thermoplastic material formulation having a third dry melting point lower than said first and second melting points, on the composite pigment layer.

8. The method of claim 7, wherein the formulation of the first layer includes pigmentation having a color other than white, and the formulation of the second layer includes white pigmentation.

9. The method of claim 7, wherein the formulation of the first layer includes a material selected from the group consisting of glitter, perlescent, and beads.

10. The method of claim 7, wherein the total thickness of the plastic web, is less than about 15 mils.

11. The method of claim 7, wherein the formulation of the first layer defines a first color and the formulation of the second layer defines a second color different than said first color.

12. The method of claim 7, wherein the carrier sheet has a slip-treated upper surface.

13. The method of claim 7, including the step of formulating the first layer of pigmented polyurethane, with at least one ingredient of the group consisting of cross-linkers, slip agents, adhesion promoters, coupling agents, or surfactants.

14. The method of claim 7, wherein the first layer is solution coated directly onto the carrier sheet.

15. The method of claim 7, wherein each layer is applied by solution coating, and the web is thereafter dried to produce a peel value between the first layer and the carrier sheet, in the range of about 15–30 ounces.

16. The method of claim 14, wherein the second and third layers are solution coated on the first and second layers, respectively, while the first layer and second layer are still wet, respectively.

* * * * *